United States Patent [19]

Yamaguchi et al.

[11] Patent Number: 4,714,026

[45] Date of Patent: Dec. 22, 1987

[54] PALLET FOR MATERIAL HANDLING

[75] Inventors: Akio Yamaguchi, Saitama; Kazushi Yoshikawa, Mie, both of Japan

[73] Assignee: Honda Giken Kogyo Kabushi Kaisha, Tokyo, Japan

[21] Appl. No.: 849,208

[22] Filed: Apr. 7, 1986

[30] Foreign Application Priority Data

| | | | |
|---|---|---|---|
| Apr. 17, 1985 | [JP] | Japan | 60-80066 |
| Apr. 17, 1985 | [JP] | Japan | 60-56178[U] |
| Apr. 17, 1985 | [JP] | Japan | 60-56179[U] |

[51] Int. Cl.[4] ..... B65D 19/00

[52] U.S. Cl. ..... 108/51.1; 108/51.3

[58] Field of Search ..... 108/51.1, 51.3, 55.1, 108/55.3, 56.3, 901, 902; 206/386, 599, 600

[56] References Cited

U.S. PATENT DOCUMENTS

| | | | |
|---|---|---|---|
| 1,518,497 | 12/1924 | Flood et al. | 108/550.1 X |
| 2,503,240 | 4/1950 | Cahners | 108/51.3 |
| 3,246,824 | 4/1966 | Gardner | 108/51.3 X |
| 3,327,889 | 6/1967 | Dore | 108/55.1 X |
| 3,434,435 | 3/1969 | Achermann et al. | 108/51.3 |
| 3,520,258 | 7/1970 | Shephard | 108/51.3 |
| 3,568,912 | 3/1971 | Simas | 108/51.3 X |
| 3,626,860 | 12/1971 | Blatt | 108/51.3 |
| 3,861,326 | 1/1975 | Brown | 108/51.1 |
| 3,911,182 | 10/1975 | Lieberman | 108/51.1 X |
| 4,050,664 | 9/1977 | Daley | 108/55.5 X |
| 4,142,471 | 3/1979 | Mustoe et al. | 108/51.1 X |
| 4,228,744 | 10/1980 | Moore | 108/51.3 |
| 4,230,049 | 10/1980 | Horne | 108/51.3 X |
| 4,467,004 | 8/1984 | Liebel | 108/51.3 X |

FOREIGN PATENT DOCUMENTS

| | | | |
|---|---|---|---|
| 2607599 | 9/1977 | Fed. Rep. of Germany | 108/55.3 |
| 2490187 | 3/1987 | France | 108/51.3 |
| 1498808 | 1/1978 | United Kingdom | 108/51.1 |

*Primary Examiner*—Kenneth J. Dorner
*Assistant Examiner*—José V. Chen
*Attorney, Agent, or Firm*—Michael J. Striker

[57] ABSTRACT

A pallet for material handling comprises a deck board and a pluralities of legs which are fixed to the under surface of the deck board with specified spacings. The deck board is constituted of laminated corrugated fibreboard, and each of the legs is formed by a square-tubular frame, which is made of a corrugated fibreboard, and in which a pad or pads made of plastic resin is inserted. The deck board of a durable light weight structure, has a roughened top surface to prevent slips of a cargo. The legs are so constructed to support heavy load without deforming and collapse, and are designed to prevent absorption of moisture.

20 Claims, 21 Drawing Figures

PALLET FOR MATERIAL HANDLING

BACKGROUND OF THE INVENTION

1. Field of the Invention

The present invention relates to a pallet for material handling, basically made of corrugated fibreboards.

2. Description of the Prior Art

The conventional pallets so far developed are made of wood, iron, plastic resin, paper, etc. and the most frequently used ones are made of wood, because of their merits of easy repairs and relative non-slippiness.

Wooden pallets, however, which use timbers of some restricted kinds and properties and indispensably need insecticide smoking treatment, have presented some problems in the conservation of resources and in production cost. On the other hand, paper pallets, which are more favorable in their lower production costs and lighter weight, have encountered some problems including load bearing ability and durability.

SUMMARY OF THE INVENTION

It is an object of the present invention to propose a material handling pallet which can overcome the aforementioned problems and is basically made of corrugated fibreboards which is especially light in weight and inexpensive to manufacture and, at the same time, capable of durability.

It is another object of the present invention to provide a material handling pallet, as above, that is capable of preventing a cargo slipping in loading or carrying and is easy to palletizate.

It is a further object of the present invention to provide a material handling pallet which is so consstructed as to be convenient in handling by a forked material handling cart, such as fork lift truck and hand lift truck.

In achieving these objects, the present invention provides a pallet for material handling including a deck board made of laminated corrugated fibreboards and top surface of said deck board formed in rough or coated by some protective film having high friction coefficient, while several legs which are constituted of a corrugated fibreboard frame and a plastic resin pad to be inserted into the inside of said frame are fixed to the under surface of said deck board with specified spacings.

In a pallet for material handling of the present invention, a protruded end portion is projected upwardly beyond the deck board from said frame, further a bottom plate covering all the frames is bonded to the under surface of said every frames and openings are formed in said bottm plate at specified locations so as to permit wheels of the forks of a cart to push therethrough.

According to the present invention, since every legs fixed to the under surface of the deck board which is made of laminated corrugated fibreboards is constituted of a square tubular frame which is made of the corrugated fibreboard and of a plastic resin pad which is inserted into the inside of said frame, it is possible to provide a high ability for load bearing and bending resistance compared with conventional paper pallets, in addition the material handling pallet of the present invention is also advantageous in its light weight and in being manufactured inexpensively compared with wooden pallets which are prevailing in present markets. Further, with the present invention, since the deck board in which load surface for cargo is formed in rough and the protruded end portion prevent a cargo slipping, it is possible to facilitate loading and limit free shifting of a cargo.

Further advantages of the present invention include features that the fork of a cart can be inserted easily between frames fixed to the under side of the deck board, that the inserted plastic resin pads in each frame ensure high enough stiffness of the frame to withstand rough handling manners during operation, and moreover, that the water-resistance of the pad prevents its absorption of moisture even during a long stay in an indoor or outdoor environment to ensure the durability of the pallet.

BRIEF DESCRIPTION OF THE DRAWINGS

The above and further objects and advantages of the present invention will be apparent from the following description and accompanying drawings, wherein.

DESCRIPTION OF THE PREFERRED EMBODIMENT

Figure 1:
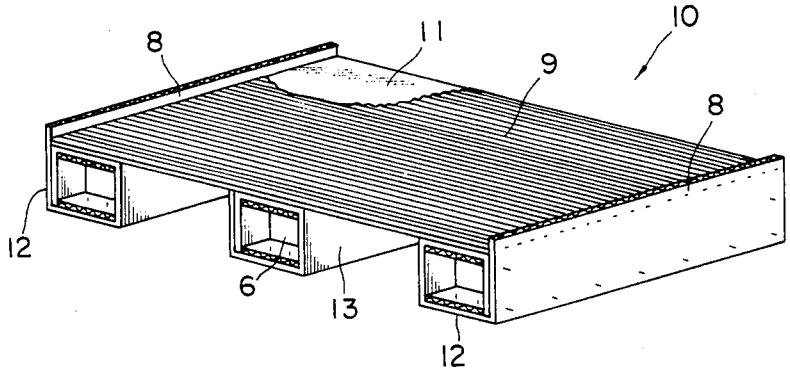
FIG. 1 is a partially cutaway perspective view of a preferred embodiment of the present invention.
Figure 3:
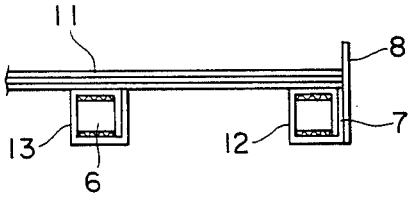
FIG. 3 is a partial front view to illustrate the state of individual the protruded end portion as provided along side wall of the pallet.
Figure 2A:
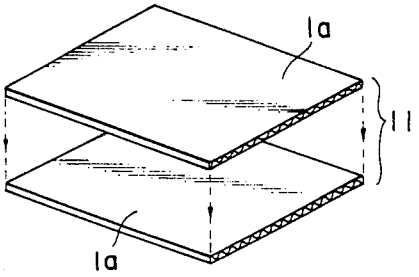
FIGS. 2A through 2G are perspective views of individual component parts to illustrate in detail the construction of the pallet shown in FIG. 1.
Figure 2B:
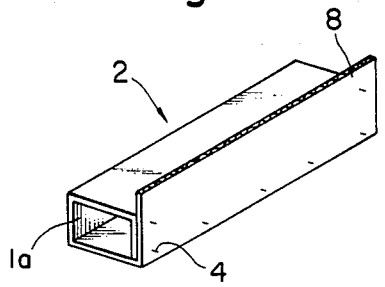
Figure 2C:
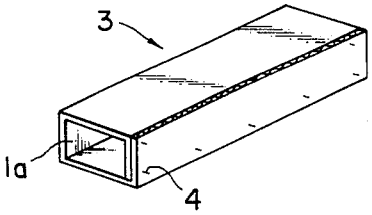

Specific descriptions of the pallets of the present invention are given below, referring to the drawings. Reference numeral 11 in FIGS. 1 through 3 shows a deck board, one of the component parts of a pallet 10 of the present invention. The deck board 11 is made of a plurality of rectangular or square corrugated fibreboards 1*a* of, for example, the double face type, laminated together (FIG. 2A). Square-tubular frames 2,3 constitute the main body of legs 12, 13, respectively, that are fixed on to the under surface of the deck board 11 in a parallelly aligned position with specified spacings. Each of the square-tubular frames 2 and 3 is made of corrugated fibreboard similar in quality to those used for the deck board 11. Specifically, as illustrated in FIGS. 2B or 2C, a double-faced corrugated fibreboard 1*a* is angularly bent and rolled to form a square tube, further is fixed by staples 4 on its side portion as it is so bent and then several square-tubular frames 2, 3 are made.

Figure 2D:
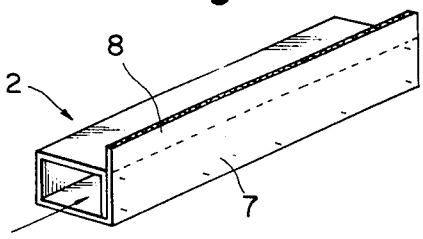
Figure 2D:
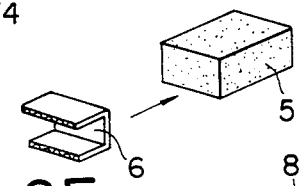
Figure 2E:
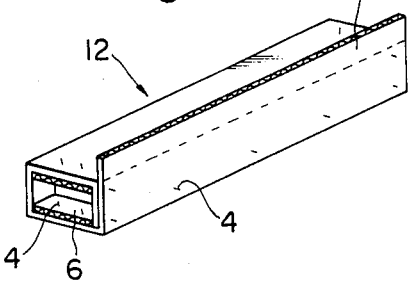

In a pad 5 made of an elastic plastic resin such as expanded polystyrene, is inserted into the inside of every square-tubular frame, for example inserted through each opening at the end of every tubular frame as shown in FIG. 2D, then each opening of the frame is sealed by a cap 6 made of a corrugated fibreboard which has a channel-shaped section, as shown in Fig.2E, and the cap 6 is fixed to the end part of the frame by staples 4.

Figure 2F:
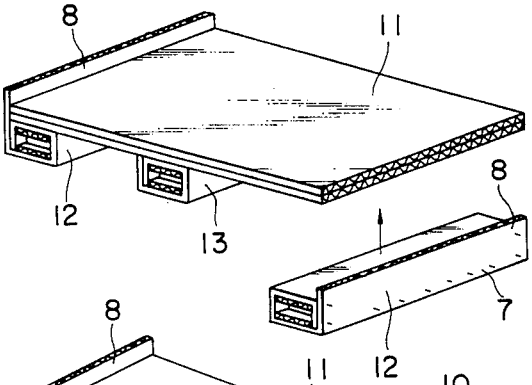
Figure 2G:
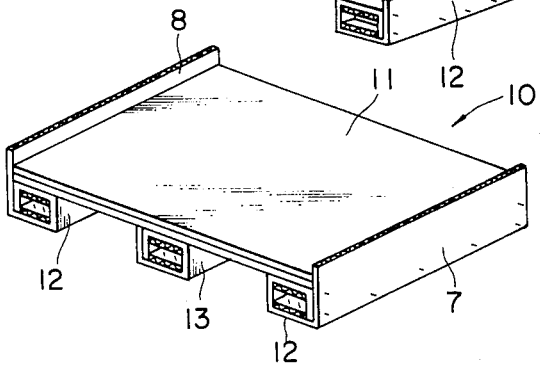

Incidentally, for purposes of illustration, the pad 5 is placed into through the inside of both ends of tubular frame, may be otherwise inserted into through full length of the longitudinal direction thereof. The legs 12, 13 are usually three legs as a set, as shown in FIGS. 2F and 2G, two legs 12 of which are laid along the two opposite end under side edges of the deck board 11, and one center leg 13 of which is located at the center of the deck board. Every leg is formed to have an identical height. The top surface of every frame is fixed to the under side of the deck board 11 by bond or staples, so that all three legs, which also function as beams are aligned on the under side of the deck board 11 mutually in parallel with specified spacings, as shown in FIG. 2G.

In FIGS. 2F and 2G, each leg 12 along each of the two opposite end edges has a protruded end portion 8 projecting the one end portion 7 of the frame 2 upwardly. The protruded end portion 8 is formed so that an upper end portion thereof is projected upwardly beyond the deck board 11. The protruded end portion also reinforces the rigidity of the leg 12 along the board edge to resist bending in the axial direction, and furthermore functions as a stopper that prevents the slip of a cargo on the deck board. In this embodiment the protruded end portion 8 constitutes an extended part of one end portion of the frame 2, the protruded end portion 8 may, otherwise, be bonded to the side of the legs 12 as a separate piece that forms a fourth vertical side wall which is parallel to a third vertical side wall which is to be described below, as illustrated in FIG. 3.

Because the deck board body is formed by the laminated corrugated fibreboards as described above, and also because square-tubular frames, so constructed as described below, is fixed to the under side of the deck board body with specified spacings, the deck board body can bear a heavy cargo load without a risk of its breakage, and it can show a high bending resistance. Besides, since the square-tubular frames 2, 3 are made of angularly bent corrugated fibreboard and includes first, second and third vertical side walls, respectively, it is possible to resist breaking, moreover, the plastic resin pad 5 inserted into the frame enhances the strength of the leg against bending and collapse. In addition, the water resistance of these pads precludes the possibility of its absorbing water or moisture even during its long indoor or outdoor stay.

For the pallet of the invention, each squaretubular shape frame 2 protects the pad 5 in it from an impact that may be given by a fork of a material handling cart, when the fork is inserted between frames under the deck board.

In FIG. 1, reference numeral 9 indicates a corrugated sheet which is bonded to the upper side of the deck board 11, with its flutes up, to increase the friction coefficient of the upper side surface against a cargo in order to prevent cargo slips.

Corrugation flutes of a corrugated sheet 9 are oriented in the longitudinal direction of the deck board 11, or namely orthogonal to the protruded end portion 8.

Prevention of cargo slips is secured by roughened surface of the deck board in any discretionary manner, such as bonding the corrugated sheet on the upper surface of the deck board. The purpose can also be met by coating paraffin wax or the like agent on the upper surface of the board to form a protective film having high friction coefficient.

Figure 4:
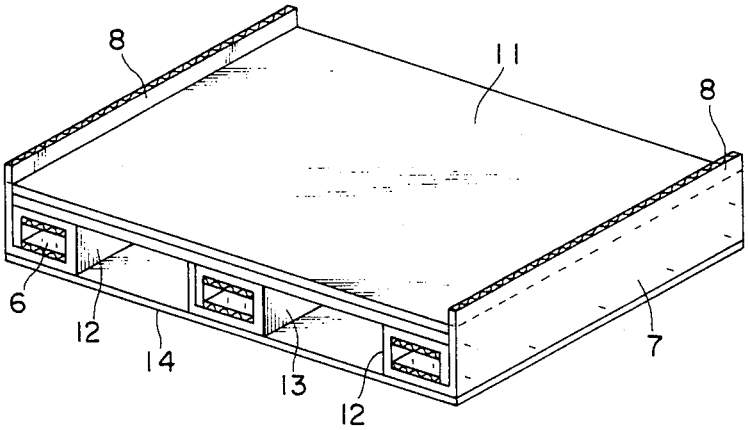
FIG. 4 is a drawing similar to FIG. 1 to illustrate a modified embodiment of the present invention.

FIG. 4 is a modified embodiment of the invention, having a bottom plate 14 fixed on to the upper surface of all the three legs. In this figure, the corrugated sheet to be bonded to the top surface of the deck board is not illustrated. It is desirable that all the deck board, frame materials , bottom plate, and corrugated sheet are applied water resistance treatment such as soaking in or application of water resistant agents represented by paraffin wax.

Figure 5:
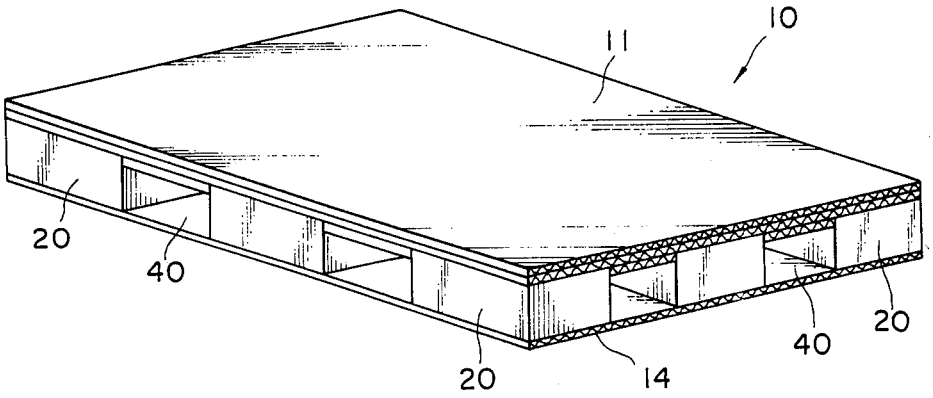
FIG. 5 is a partially cutaway perspective view of another embodiment of the present invention.

FIG. 5 and subsequent figures show another embodiment of the invention. In a pallet in FIG. 5, a plurality of box-shaped legs 20 are fixed with specified spacings to the under surface of the deck board 11 made of laminated corrugated fibreboard, and the bottom plate 14 is bonded to the under surface of all the legs to unit them in a body. FIGS. 6A through 6F are exploded and partial views to show a detailed construction of above pallet. Reference numeral identical to the preceding embodiment are given to the same elements, including the deck board and bottom plate.

Figure 6A:
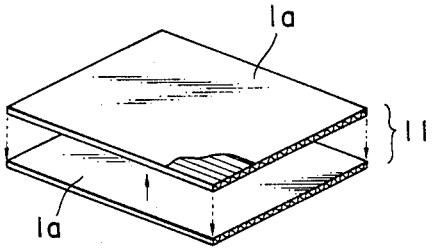
FIG. 6A through 6F are perspective views of individual component parts to illustrate in detail the construction of the pallet shown in FIG. 5.
Figure 6B:
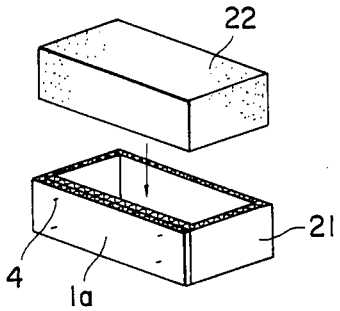
Figure 6C:
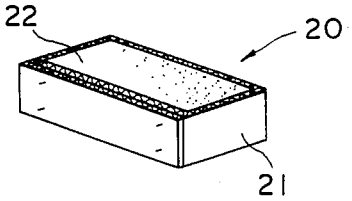

The box leg 20 is constituted, as illustrated in FIG. 6B, by a short square-tubular frame 21 which is formed by angularly rolling and stapling the corrugated fibreboard, and by a pad 22 made of elastic plastic resin such as expanded polystyren and inserted in the frame. Pluralities of such box legs 20, all having the same height, and arranged laterally with specified spacings, with the deck board 11 placed on their top, and with the bottom plate 14 under them.

Figure 6D:
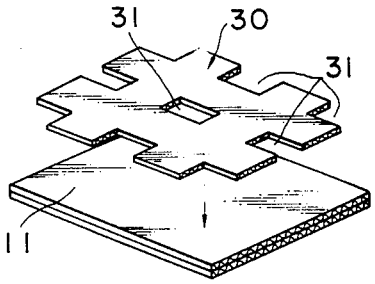
Figure 6E:
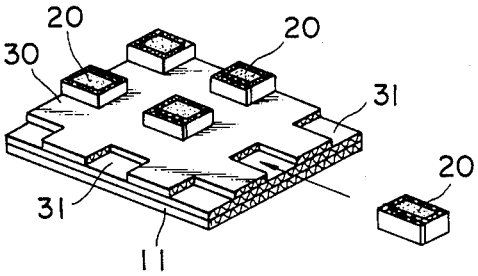
Figure 6F:
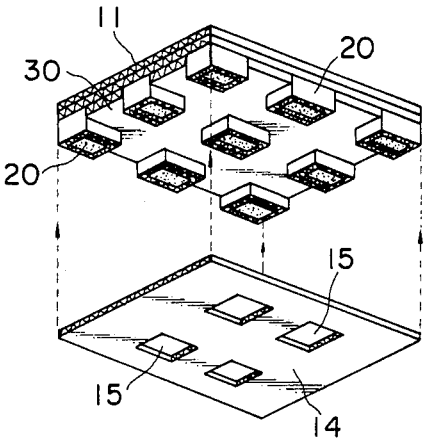

For fixing the box legs 20 in such positions, a leg-holder plate 30 made of a corrugated fibreboard having notches that correspond to the size of individual box legs is employed. This leg-holder plate 30 is provided with notches 31 which give the plate an appearance of a grid in terms of a plan view. The leg-holder plate 30 is bonded to the upper surface of the deck board 11 as illustrated in FIG. 6D, and then receive in its notches 31 the box legs 20, so that the box legs are held with specified spacings to function as legs. Bonding agent is applied to both the upper and under surface of the box legs 20 to combine the deck board 11 and the bottom plate 14 together by the medium of the box legs 20.

In above embodiment, a total of nine box legs 20 are provided in a matrix of three rows and columns allowing the pallet to have sufficient fork holes 40 to receive the fork of a cart from either of the four lateral directions.

The plastic resin pad 22 inserted in the corrugated fibreboard frame 21, which is formed in a square tubular shape, ensures high strength of the box leg 20 against bending and collapse. Moreover, the pad has water resistance ability that precludes the absorption of water or moisture even during a long indoor or outdoor stay. The square-tubular frame 21 protects the pad 22 from an impact that may be given when a fork is inserted.

Figure 7:
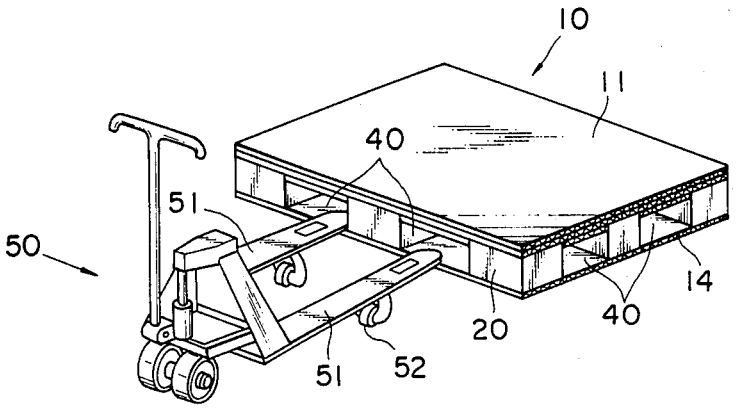
FIG. 7 is a perspective view to illustrate an exemplar case of carrying the pallet of FIG. 5 by a material handling cart.
Figure 8A:
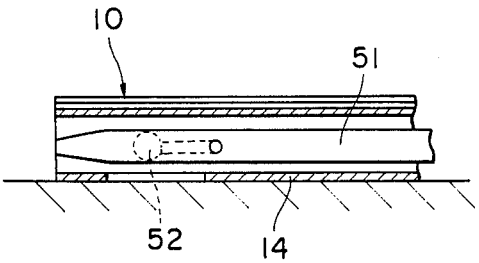
FIGS. 8A and 8B are partial sectional views illustrating how the fork of a cart in FIG. 7 is inserted in the pallet.
Figure 8B:
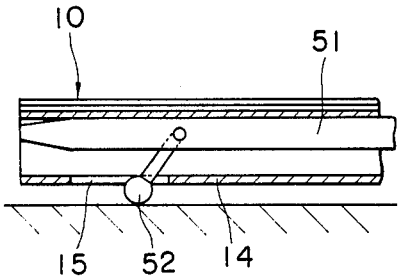

The bottom plate 14 is also made of the corrugated fibreboard like the deck board. The bottom plate has four openings (windows) 15 at the specified locations so as to allow wheels provided under the fork to protrude downwardly through said openings 15 in receiving the fork of a cart. Specifically, when a cart 50 shown in FIG. 7 is to lift up and carry a pallet 10, a fork 51 of the cart 50 is inserted in the pallet through insert holes 40 as shown in FIGS. 8A and 8B. Then, a small wheel 52 under each branch of the fork is levered down so much as to protrude out of the window 15 to lift up the pallet 10.

Figure 9:
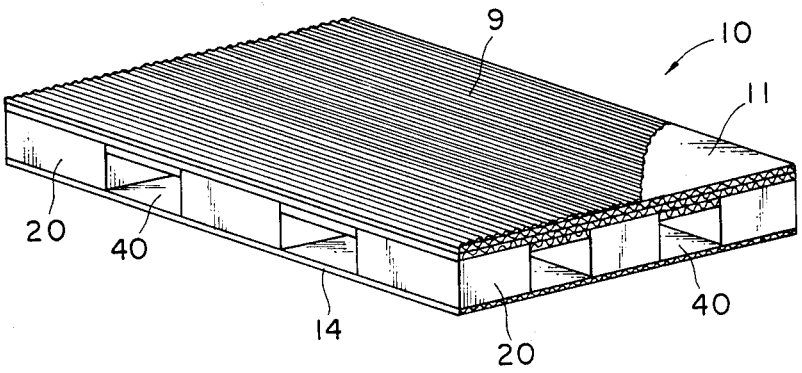
FIG. 9 is a perspective view illustrating a modified form of the pallet shown in FIG. 5.

FIG. 9 illustrates a modified form of the pallet in FIG. 5, where the corrugated sheet 9 is bonded to the top surface of the deck board 11. As mentioned above, the corrugated fibreboard prevents the cargo slipping by enhancing the friction coefficiency of a cargo-loading surface, while the deck board applied embossing treatment can further enhance the same effects.

Although the invention has been described in its preferred form with a certain degree of particularity, it is understood that the present disclosure of the preferred form has been changed in the details of construction, and the combination and arrangement of parts may be resorted to, without departing from the spirit and the scope of the invention as hereinafter claimed.

What is claimed is:

1. A pallet for material handling, comprising:

a deck board made of corrugated fibreboard and having a lower surface facing downward, an upper surface facing upward, and at least two vertical side walls facing sideway opposite each other, said upper surface having a friction coefficiency;

means for enhancing said friction coefficiency of said upper surface and including a member arranged on said upper surface with a friction coefficient greater than that of said upper surface;

square tubular legs fixed to said lower surface and each constituting a square-frame, said square tubular legs being composed of corrugated fibreboard and having an open end portion and an axial direction;

means for strengthening said square tubular legs against bending and collapse, said strengthening means including a plastic resin pad arranged within said square tubular legs;

means for sealing said end portions of said tubular legs and including a cap; and means for reinforcing at least two of said square tubular legs to resist bending in said axial direction and for preventing slippage of material to be handled, said reinforcing and preventing means including a protruded end portion formed on each of said two square tubular legs as an extended part thereof, said protruded end portion being arranged to project upward beyond said member on said upper surface and bieng attached to a respective one of said two vertical side walls, said protruded end portion including a third vertical side wall parallel to said two vertical side walls.

2. A pallet for material handling set forth in claim 1 wherein said protruded end portion and said corrugated sheet are placed in relative orthogonal directions.

3. A pallet for material handling set forth in claim 1 wherein said plastic resin pad is made of expanded polystyren resin.

4. A pallet for material handling set forth in claim 1 wherein said cap is made of the corrugated fibreboard and has a channel-shaped cross-section.

5. A pallet for material handling set forth in claim 1 wherein a bottom plate is bonded to said lower surface of said square-tubular frames.

6. A pallet for material handling set forth in claim 5 wherein said bottom plate is formed water-resistant.

7. A pallet for material handling set forth in claim 1, wherein at least a portion of said deck board, said corrugated sheet, said square-tubular frame, and said cap, are formed water-resistant.

8. A pallet as set forth in claim 1, wherein said protruded end portion includes a fourth vertical side wall parallel to said two vertical side walls and therefore also to said third vertical side wall.

9. A pallet as set forth in claim 8, wherein said fourth vertical wall is formed contiguous with a respective one of said two square tubular legs on which said protruded end portion is formed.

10. A pallet for material handling, comprising:

a deck board made of corrugated fibreboard and having a lower surface facing downward, an upper surface facing upward, and at least two side walls facing sideways opposite each other, said upper surface having a friction coefficiency;

means for enhancing said friction coefficiency of said upper surface and including a member arranged on said upper surface with a friction coefficient greater than that of said upper surface;

tubular legs fixed to said lower surface and each consituting a square-frame, said tubular legs being composed of corrugated fibreboard and having an open end portion and an axial direction;

means for strengthening said tubular legs against bending and collapse, said strengthening means including a plastic resin pad arranged within said tubular legs;

means for sealing said end portions of said tubular legs and including a cap;

means for reinforcing at least two of said tubular legs to resist bending in said axial direction and for preventing slippage of material to be handled, said reinforcing and preventing means including a protruded end portion formed on each of said two tubular legs as an extended part thereof, said protruded end portion being arranged to project upward beyond said member on said upper surface and being attached to a respective one of said two side walls; and a bottom plate bonded to said lower surface of said square frame, said bottom plate being formed to have a plurality of openings at predetermined locatios.

11. A pallet for material handling, comprising:

a deck board made of corrugated fibreboard and having a lower surface facing downward, an upper surface facing upward, and at least two vertical side walls facing sideways opposite each other, said upper surface having a friction coefficiency;

means for enhancing said friction coefficiency of said upper surface and including a member arranged on said upper surface with a friction coefficient greater than that of said upper surface;

square tubular legs fixed to said lower surface and each constituting a square-frame, said square tubular legs being composed of corrugated fibreboard and having an open end portion and an axial direction;

means for strengthening said square tubular legs against bending and collapse, said strengthening means including a plastic resin pad arranged within said square tubular legs;

means for sealing said end portions of said square tubular legs and including a cap; and means for reinforcing at least two of said square tubular legs to resist bending in said axial direction and for preventing slippage of material to be handled, said reinforcing and preventing means including a protruded end portion formed on each of said two square tubular legs as an extended part thereof, said protruded end portion being arranged to project upward beyond said member on said upper surface and being attached to a respective one of said two vertical side walls, said protruded end portion including a third vertical side wall parallel to said two vertical side walls, said enhancing means member being formed as a corrugated sheet boned to said upper surface.

12. A pallet for material handling, comprising:

a deck board made of corrugated fibreboard and having a lower surface facing downward, an upper surface facing upward, and at least two vertical side walls facing sideways opposite each other, said upper surface having a friction coefficiency;

means for enhancing said friction coefficiency of said upper surface and including a member arranged on said upper surface with a friction coefficient greater than that of said upper surface;

square tubular legs fixed to said lower surface and each constituting a square-frame, said square tubular legs being composed of corrugated fibreboard and having an open end portion and an axial direction;

means for strengthening said square tubular legs against bending and collapse, said strengthing means including a plastic rsin pad arranged within said square tubular legs;

means for sealing said end portions of said square tubular legs and including a cap; and means for reinforcing at least two of said square tubular legs to resist bending in said axial direction and for preventing slippage of material to be handled, said reinforcing and preventing means including a protruded end portion formed on each end of said two square tubular legs as an extended part thereof, said protruded end portion being arranged to project upward beyond said member on said upper surface and being attached to a respective one of said two vertical side walls, said protruded end portion including a third vertical side wall parallel to said two vertical side walls, said enhancing means member being formed as a coating on said upper surface, said coating having a friction coefficient greater than that of said upper surface.

13. A pallet for material handling, comprising:

a deck board made of corrugated fibreboard and having a lower surface facing downward, an upper surface facing upward, and at least two side walls facing sideways opposite each other, said upper surface having a friction coefficiency;

means for enhancing said friction coefficiency of said upper surface and including a member arranged on said upper surface with a friction coefficient greater than that of said upper surface;

tubular legs fixed to said lower surface and each constituting a square-frame, said tubular legs being composed of corrugated fibreboard and having an open end portion and an axial direction;

means for strengthening said tubular legs against bending and collapse, said strengthing means including a plastic resin pad arranged within said tubular legs;

means for sealing said end portions of said tubular legs and including a cap; and means for reinforcing at least two of said tubular legs to resist bending in said axial direction and for preventing slippage of material to be handled, said reinforcing and preventing means including a protruded end portion formed on each of said two tubular legs as an extended part thereof, said protruded end portion being arranged to project upward beyond said member on said upper surface and being attached to a respective one of said two side walls, both said protruded end portion and a corresponding one of said legs, on which said protruded end portion is formed as an extended part thereof, being formed as one piece.

14. A pallet for material handling, comprising:

a deck board having a lower surface facing downward, an upper surface facing upward, and two vertical side surfaces facing sideways, said deck board being composed of corrugated fibreboard, said upper surface having a friction coefficiency;

means for enhancing said friction coefficiency of said upper surface and including a memmber arranged on said upper surface with a friction coefficient greater than that of said upper surface;

at least two square tubular legs fixed to said lower surface, said square tubular legs having an axial direction:

means for strengthening said square tubular legs against bending and collapse, said strengthening means including a strengthening member arranged within said square tubular legs; and means for reinforcing said two square tubular legs to resist bending in said axial direction and for preventing slippage of material to be handled, said reinforcing and preventing means including a protruded end portion formed on each of said two square tubular legs as an extended part thereof, said protruded end portion being arranged to project upward beyond said enhancing means and being attached to a respective one of said vertical side surfaces, said protruded end portion including a third vertical side wall parallel to said two vertical side walls.

15. A pallet as set forth in claim 14, wherein said enhancing means includes a corrugated sheet bonded to said upper surface.

16. A pallet as set forth in claim 14, wherein said enhancing means member is formed as a coating on said upper surface, said coating having a friction coefficient greater than that of said upper surface.

17. A pallet as set forth in claim 14, wherein said two tubular legs have open end portions, said strengthening member being formed as a plastic resin pad: further comprising:

means for sealing said end portions and including a cap.

18. A pallet as set forth in claim 14, wherein both said protruded end portion and a corresponding one of said legs, on which said protruded end portion is formed as an extended part thereof, are formed as one piece.

19. A pallet as set forth in claim 14, wherein said protruded end portion includes a fourth vertical side wall parallel to said two vertical side walls and therefore also to said third vertical side wall.

20. A pallet as set forth in claim 19, wherein said fourth vertical wall is formed contiguous with a respective one of said two square tubular legs on which said protruded end portion is formed.

* * * * *